US006360506B1

(12) United States Patent
Graae

(10) Patent No.: US 6,360,506 B1
(45) Date of Patent: Mar. 26, 2002

(54) BITUMINOUS ROOFING MEMBRANE, AND METHOD OF JOINING TWO ROOFING MEMBRANES

(75) Inventor: Niels Graae, Werne (DE)

(73) Assignee: Icopal GmbH, Werne (DE)

( * ) Notice: Subject to any disclaimer, the term of this patent is extended or adjusted under 35 U.S.C. 154(b) by 0 days.

(21) Appl. No.: 09/602,453

(22) Filed: Jun. 23, 2000

(30) Foreign Application Priority Data

Jun. 25, 1999 (DE) ..... 299 11 125

(51) Int. Cl.[7] ..... E04D 1/36

(52) U.S. Cl. ..... 52/408; 52/540; 52/552; 52/746.11; 156/71; 156/292; 428/141; 428/489

(58) Field of Search ..... 52/408, 409, 411, 52/454, 169.14, 265, 267, 540, 527, 555, 558, 552, 746.11, 516; 156/71, 23.5, 290, 292; 428/489, 141, 40.3

(56) References Cited

U.S. PATENT DOCUMENTS 3,937,640 A * 2/1976 Tajima et al. ..... 156/71
4,039,706 A * 8/1977 Tajima et al. ..... 428/40
4,091,135 A * 5/1978 Tajima et al. ..... 428/40
4,235,058 A * 11/1980 Patry ..... 52/408
4,248,926 A * 2/1981 Tajima et al. ..... 428/253
4,636,414 A * 1/1987 Tajima et al. ..... 428/40
4,670,071 A * 6/1987 Cooper et al. ..... 156/71

* cited by examiner

*Primary Examiner*—Carl D. Friedman
*Assistant Examiner*—Winnie Yip
(74) *Attorney, Agent, or Firm*—Henry M. Feiereisen

(57) ABSTRACT

A roofing membrane, includes a bottom layer of meltable non-woven plastic or other meltable plastic layer, a first layer made of bitumen, in particular elastomeric bitumen, a carrier sheet made of non-woven or fabric having tensile strength, a second layer made of bitumen, in particular elastomeric bitumen, a top layer having a marginal area suitable for welding to an overlapping marginal area of a bottom layer of a following second such roofing membrane, a bitumen strip exhibiting self-sticking properties in cold condition and positioned at the marginal area of at least the bottom layer or the top layer, and a peel-off film placed over the bitumen strip before laying of the roofing membrane.

17 Claims, 1 Drawing Sheet

BITUMINOUS ROOFING MEMBRANE, AND METHOD OF JOINING TWO ROOFING MEMBRANES

CROSS-REFERENCES TO RELATED APPLICATIONS

This application claims the priority of German Patent Application, Ser. No. 299 11125.3, filed Jun. 25, 1999, the subject matter of which is incorporated herein by reference.

BACKGROUND OF THE INVENTION

The present invention relates, in general, to roof sheeting material, and in particular to roofing membranes.

Roofing membranes are known in many configurations for use in flat roofs or sloping roofs. At least in conjunction with wooden roofs or roof substructures of wood, a separation and protective layer, e.g. a coarsely grained bituminous roof surfacing mat, is typically nailed on initially. Thereafter, known roofing membranes are laid by welding a first bituminous web onto the separation and protective layer or by securing the first web with nails in the region which is overlapped subsequently by a second bituminous web. The second web is then welded together with the first web in the overlapping zone, typically by using a gas burner whose flame causes the bituminous layers to fuse in the overlapping zone. Then, further webs are laid in a same manner. Oftentimes, a further sealing liner is welded across the entire the first layer.

SUMMARY OF THE INVENTION

It is an object of the present invention to provide an improved roofing membrane which is simpler to lay out.

These objects, and others which will become apparent hereinafter, are attained in accordance with the present invention by providing a roofing membrane which includes a bottom layer of meltable non-woven plastic or other meltable plastic layer, a first layer made of bitumen, in particular elastomeric bitumen, a carrier sheet made of non-woven material or woven fabric having tensile strength, a second layer made of bitumen, in particular elastomeric bitumen, a top separation layer having a marginal area suitable for welding to an overlapping marginal area of a bottom layer of a second such roofing membrane to be attached, a bitumen strip exhibiting self-sticking properties in cold condition and positioned at the marginal area of the bottom layer or top layer, and a peel-off film placed over the bitumen strip before laying of the roofing membrane.

A roofing membrane according to the present invention can be laid in a same manner as a conventional roofing membrane, with the difference residing in the fact that the self-sticking bitumen strip effects an adhesion, if necessary after being pressed on, of the overlapping second roofing membrane immediately after being laid upon the marginal area of the overlapped first roofing membrane. Therefore, a gas burner can be used to initiate a fusion of the bitumen in the overlapping region of both roofing membranes, without risking a penetration of the flame through the gap between the perimeter of the first roofing membrane and the overlapping part of the second roofing membrane. During melting of the bitumen in the overlapping region, the top separation layer of the first roofing membrane, or a plastic film provided in the overlapping region, fuses in a conventional fashion with the non-woven plastic of the bottom layer of the second roofing membrane. Once the bitumen of both roofing membranes has sufficiently been heated up, the overlapping marginal strip of the second roofing membrane is pressed on the confronting marginal strip of the first roofing membrane.

It may be sufficient to provide the bitumen strip only at the bottom side or only at the top side of the roofing membrane, in the event the top separation layer or the bottom layer, respectively, of the roofing membrane at hand, i.e. the layer of the overlapping roofing membrane being attached during laying, has a sufficient tackiness. In many cases, it may, however, be suitable to provide the bottom layer as well as the top layer with a bitumen strip that is self sticking in cold condition, whereby the bitumen strip upon the bottom layer is positioned at a distance from the proximal perimeter of the roofing membrane in accordance with the width of the overlapping region, and whereby the bitumen strip in the top layer forms at the same time the periphery of the overlapping roofing membrane.

According to another feature of the present invention, the bitumen strip should have a width in the range of about 2 cm.

A sufficient anchoring of the bitumen strip in the roofing membrane is implemented especially when the bitumen strip is arranged on the carrier sheet. Thus, the bitumen strip can replace at this location the meltable bitumen or elastomeric bitumen of the first layer and second layer, respectively.

According to another preferred embodiment of the present invention, the bottom layer is made impervious to bitumen to thereby prevent gradual migration of bitumen, in particular of the first layer, through the material (non-woven plastic or other meltable plastic layer) of the bottom layer. The non-woven plastic or other plastic layer thus ensures a secure separation of the roofing membrane from the substructure. In this way, there is no need for a distinct separation and protective layer between the wooden substructure and the roofing membrane, in particular in combination with the provision of the self-sticking bitumen strip. As described above, the provisional cold bonding action between overlapping roofing membranes before their fusion prevents the formation of a gap between the membranes through which the flame of the gas burner could otherwise reach the wooden substructure or the underside of the roofing membrane of non-woven plastic or other plastic layer, e.g. polystyrene.

The non-woven plastic of the bottom layer may suitably be provided with a plastic film to render the bottom layer impervious to bitumen. Other plastic layers, e.g. those of polystyrene, are by nature impervious to bitumen.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
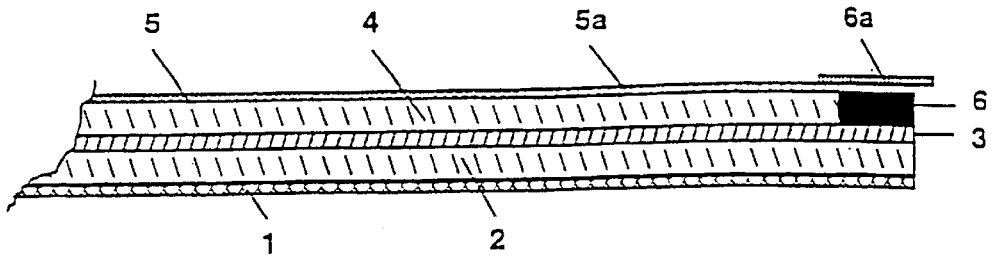
FIG. 1 is a simplified, schematic illustration of a right-hand portion of a roofing membrane according to the present invention.

Throughout all the Figures, same or corresponding elements are generally indicated by same reference numerals.

Figure 2:
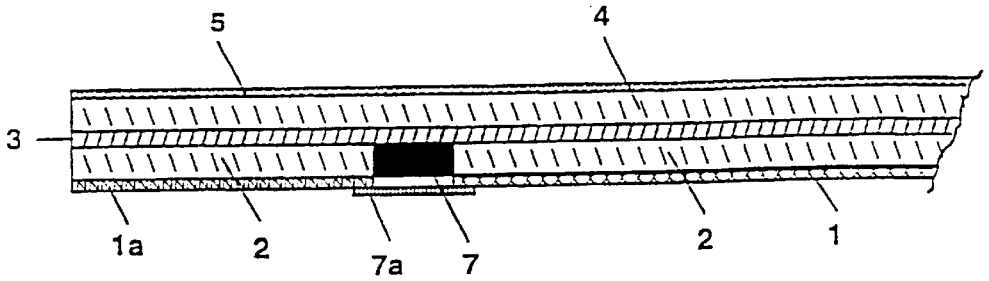
FIG. 2 is a simplified, schematic illustration of a left-hand portion of the roofing membrane FIG. 1.

Turning now to the drawing, and in particular to FIGS. 1 and 2, there are shown right-hand and left-hand marginal areas of a roofing membrane according to the present invention. It will be appreciated by persons skilled in the art that the thickness of layers shown in the drawings have been exaggerated for ease of illustration.

The roofing membrane includes a bottom layer 1 of meltable non-woven plastic material or any other suitable material that is known to the artisan for use as bottom layer of the roofing membrane. Placed over the bottom layer is a first layer 2 of bitumen, in particular elastomeric bitumen. The layer 2 adheres to a carrier sheet 3 which exhibits a sufficient resistance against yanking of nails. Suitable materials for the carrier sheet 3 include glass fiber mats, glass fabrics, polyester mats, polyester fabrics, lattices or combinations thereof. Placed over the carrier sheet 3 is a second layer 4 of bitumen, in particular elastomeric bitumen, which is covered by a top separation layer 5. Examples of the separation layer 5 include roofing slate or the like, non-woven plastics or a plastic sheet. If not meltable by a gas flame, the separation layer 5 extends shy of the right-hand edge of the roofing membrane but terminates at a distance thereto in accordance with an intended overlap width, as shown in FIG. 1. The right-hand edge of the roofing membrane is formed by a bituminous strip 6 which has self-sticking properties in cold condition and is covered by a peel-off film 6*a*. In the remaining part of the overlap zone to the commencement of the top separation layer 5, the second layer 4 of bitumen is covered by a meltable plastic film 5*a*.

As shown in FIG. 2, the left-hand border of the same roofing membrane has a different configuration. Whereas the top separation layer 5 extends to the left-hand edge, a bitumen strip 7, having self-sticking properties in cold condition, is provided at the bottom at a distance from the left-hand edge in correspondence to the width of the overlapping region, with a peel-off film 7*a* covering the bitumen strip 7. The self-stick bitumen strip 7 breaches the first layer 2 of bitumen and adheres directly upon the carrier sheet 3, in a same manner as described above in connection with the bitumen strip 6. Of course, the self-stick bitumen strips 6 and 7 may also form only a portion of the layer thickness of the bitumen layers 2 and 4, respectively. In the event, the bottom layer 1 is of a material that is difficult to melt or cannot be melted at all, then, the bottom layer 1 extends only to the self-sticking bitumen strip 7, whereby the adjacent marginal strip, representing the overlap region, is made of a film 1*a* that is easy to melt, as shown in FIG. 2, and may be made of a same material as the film 5*a*.

Figure 3:
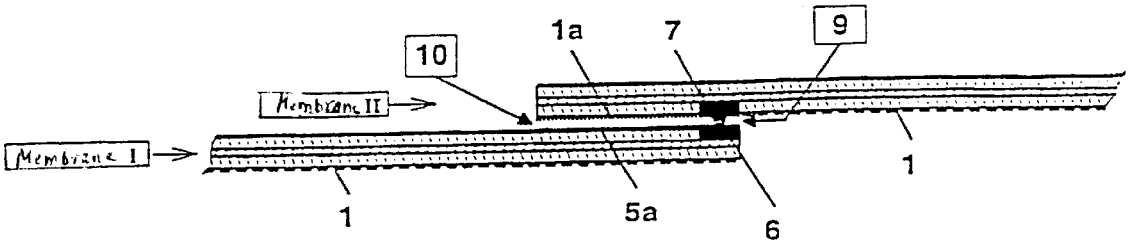
FIG. 3 is a simplified, schematic illustration of two like roofing membranes during laying process.

FIG. 3 illustrates in a highly schematic fashion the overlap region between two like roofing membranes I and II. As soon as the membrane 11 is placed upon the membrane I, the membranes I and II are bonded together via both self-sticking bitumen strips 6, 7, as indicated symbolically at 9. Of course, before placement of the membrane II upon the membrane I, the peel-off films 6*a*, 7*a* are removed. After bonding the bitumen strips 6, 7, the overlap zone II can then be folded up so as to create enough space for implementing a fusing operation between the membranes I and II by means of a flame of a gas burner, symbolically illustrated by box 10. As a consequence of the bond between the membranes I and II by means of the self-sticking bitumen strips 6, 7, the flame is prevented from penetrating to the right-hand margin of the membrane I and underneath the membrane II to reach the roof substructure (not shown). Thus, the provision of a separation and protective layer, required heretofore in conventional roof membranes under the membranes I and II, is no longer necessary even when the substructure is made of wood or other heat-sensitive material such as, e.g., slabs of foamed plastic.

In the event, the roofing membrane according to the invention is directly attached the substructure, bitumen, in particular the bitumen of the first layer 2, is prevented from migrating through the bottom layer 1 over time, when e.g., the bitumen layer 2 is heated as a result of exposure to sunlight, by making the bottom layer 1 impervious to bitumen, for example, through attachment, coating or impregnation with a film-forming plastic material.

While the invention has been illustrated and described as embodied in a roofing membrane, it is not intended to be limited to the details shown since various modifications and structural changes may be made without departing in any way from the spirit of the present invention.

What is claimed as new and desired to be protected by Letters Patent is set forth in the appended claims:

1. A roofing membrane, comprising:

a bottom layer made of a material selected from the group consisting of meltable non-woven plastic and other meltable plastic layer;

a first layer made of bitumen;

a carrier sheet made of a material having tensile strength and selected from the group consisting of non-woven material and woven fabric;

a second layer made of bitumen;

a top separation layer intended for fusion to an overlapping region of a said bottom layer of a second said roofing membrane to be attached;

a first bitumen strip exhibiting self-sticking properties in cold condition and positioned on a topside of the carrier sheet at a marginal area of the roofing membrane;

a second bitumen strip exhibiting self-sticking properties in cold condition and placed on a bottom side of the carrier sheet inwardly from an opposite marginal area of the roofing membrane by a width of the overlapping region; and a peel-off film placed over each of the bitumen strips before laying of the roofing membrane.

2. The roofing membrane of claim 1 wherein the first and second layers are made of elastomeric bitumen.

3. The roofing membrane of claim 1 wherein the bitumen strip has a width in the range of about 2 cm.

4. The roofing membrane of claim 1 wherein the bitumen strip is arranged on the carrier sheet.

5. The roofing membrane of claim 1 wherein the bottom layer is impervious to bitumen.

6. The roofing membrane of claim 5, and further comprising a plastic film covering the bottom layer.

7. A roofing membrane, comprising:

a bottom layer made of a meltable plastic material;

a first layer placed upon the bottom layer and made of bitumen;

a carrier sheet placed upon the first layer and made of high tensile material;

a second layer placed upon the carrier sheet and made of bitumen;

a top layer placed upon the second layer;

a first bitumen strip exhibiting self-sticking properties in cold condition and positioned on a topside of the carrier sheet at a marginal area of the roofing membrane;

a second bitumen strip exhibiting self-sticking properties in cold condition and placed on a bottom side of the carrier sheet inwardly from an opposite marginal area of the roofing membrane by a distance to define an overlapping region with a said top layer of a second said roofing membrane; and a peel-off film placed over each of the bitumen strips before laying of the roofing membrane.

8. The roofing membrane of claim 7, wherein the first bitumen strip is intended for bonding with the second bitumen strip positioned in confronting disposition of the second roofing membrane.

9. The roofing membrane of claim 7 wherein the bottom layer is made of meltable non-woven plastic.

10. The roofing membrane of claim 7 wherein the first and second layers are made of bitumen.

11. The roofing membrane of claim 10 wherein the first and second layers are made of elastomeric bitumen.

12. The roofing membrane of claim 7 wherein the top layer is made of a material selected from the group consisting of slate, non-woven plastics and plastic film.

13. The roofing membrane of claim 7 wherein the carrier sheet is made of a material selected from the group consisting of glass fiber mat, glass fabric, polyester mat, polyester fabric, and lattices and combinations thereof.

14. The roofing membrane of claim 7, wherein the first and second bitumen have each a width in the range of about 2 cm.

15. The roofing membrane of claim 7 wherein the bottom layer is impervious to bitumen.

16. The roofing membrane of claim 15, and further comprising a plastic film covering the bottom layer.

17. A method of joining two like roofing membranes, comprising the steps of:

placing a first roofing membrane upon a second roofing membrane such that a self-sticking first bitumen strip on a marginal area of a topside of the first roofing membrane is in contact with a self-sticking second bitumen strip positioned inwardly of a marginal area on a bottom side of the second roofing membrane in confronting relationship to the first bitumen strip, thereby forming a seal;

lifting the second roofing membrane at an area which is adjacent to the second bitumen strip and overlaps the first roofing membrane, thereby defining an accessible fusion zone; and welding the first and second roofing membranes together in the fusion zone, with the seal between the contacting first and second bitumen strips forming a barrier to prevent penetration of a gas flame during the welding operation.

* * * * *